US008226584B2

(12) United States Patent
Knapp et al.

(10) Patent No.: US 8,226,584 B2
(45) Date of Patent: Jul. 24, 2012

(54) SHIELDED TRANSDUCER FOR PLUMBING FIXTURE

(75) Inventors: Scott R. Knapp, Sheboygan, WI (US); Kenneth A. Lefeber, Plymouth, WI (US); Santosh R. Narasimhan, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 1099 days.

(21) Appl. No.: 12/051,190

(22) Filed: Mar. 19, 2008

(65) Prior Publication Data

US 2009/0235448 A1 Sep. 24, 2009

(51) Int. Cl.
*A61H 1/00* (2006.01)

(52) U.S. Cl. ..... 601/46; 601/78

(58) Field of Classification Search ..... 601/46–48, 601/78, 148–149, 163–167
See application file for complete search history.

(56) References Cited

U.S. PATENT DOCUMENTS

| | | | |
|---|---|---|---|
| 3,585,991 | A | 6/1971 | Balamuth |
| 4,430,520 | A | 2/1984 | Tibbetts et al. |
| 4,507,816 | A | 4/1985 | Smith, Jr. |
| 4,942,868 | A | 7/1990 | Vago |
| 5,101,810 | A | 4/1992 | Skille et al. |
| 5,178,134 | A | 1/1993 | Vago |
| 5,339,804 | A | 8/1994 | Kemp |
| 5,699,438 | A | 12/1997 | Smith et al. |
| 5,702,353 | A | 12/1997 | Guzzini et al. |
| 6,523,191 | B2 | 2/2003 | Lahay et al. |
| 6,836,908 | B1 | 1/2005 | Chang |
| 6,876,753 | B2 | 4/2005 | Kim |
| 2004/0016051 | A1 | 1/2004 | Gardenier et al. |
| 2005/0044619 | A1 | 3/2005 | Mattson, Jr. et al. |
| 2005/0091739 | A1 | 5/2005 | Lerma |
| 2007/0201716 | A1 | 8/2007 | Wang |

FOREIGN PATENT DOCUMENTS

| | | | |
|---|---|---|---|
| DE | 4435879 | | 4/1996 |
| DE | 19902875 | C1 | 7/2000 |
| DE | 19902874 | | 11/2000 |
| DE | 202004018797 | U1 | 4/2005 |
| EP | 0335851 | A2 | 10/1989 |
| EP | 0355299 | B1 | 2/1990 |
| EP | 0595783 | A2 | 5/1994 |
| EP | 0604742 | A1 | 7/1994 |
| EP | 0645130 | A2 | 3/1995 |
| EP | 0645131 | B1 | 3/1995 |
| EP | 651987 | | 5/1995 |
| EP | 1183967 | | 3/2002 |
| EP | 1192969 | B1 | 3/2002 |
| EP | 1192969 | B1 | 2/2005 |
| EP | 1946736 | | 7/2008 |
| JP | 04-108533 | | 9/1992 |
| JP | 2003-180784 | | 2/2003 |
| JP | 04-241600 | | 8/2008 |
| WO | 0061060 | A1 | 10/2000 |
| WO | 0232290 | A2 | 4/2002 |
| WO | 02096152 | A1 | 11/2002 |

OTHER PUBLICATIONS

PCT International Search Report. PCT/US2009/001389, filed Mar. 4, 2009. Kohler Co.

*Primary Examiner* — Michael Brown
(74) *Attorney, Agent, or Firm* — Foley & Lardner LLP

(57) ABSTRACT

Plumbing fixtures are disclosed having acoustic electromagnetic transducers mounted thereon to transmit music or other vibrations to the fixture interior. The mounting assembly provides for a shield that reduces exposure of those in the fixture to a magnetic field generated by the transducers. In one form there is a post extending from the transducer, through the shield, to a bracket on the housing. Other structures are provided to facilitate removability of the shield and transducer for maintenance purposes.

32 Claims, 6 Drawing Sheets

FIG. 6
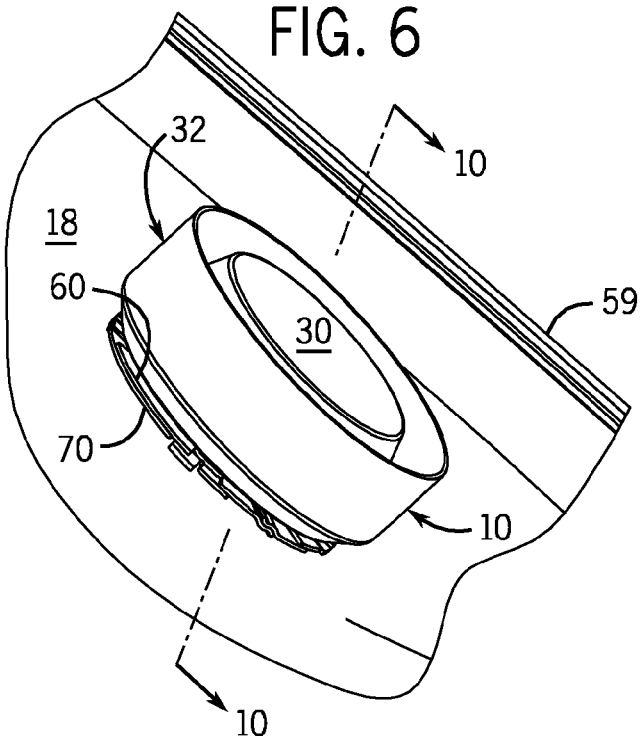
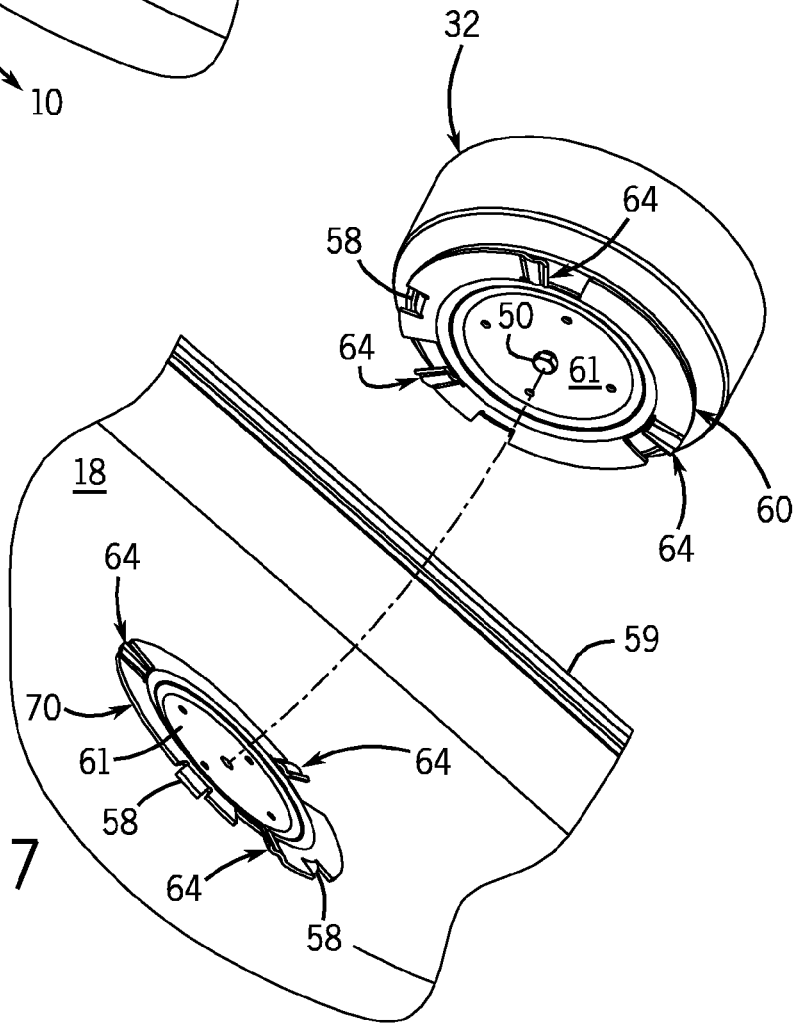
FIG. 7

SHIELDED TRANSDUCER FOR PLUMBING FIXTURE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to bath tubs, shower enclosures and the like which are provided with vibroacoustic transducers to project music and/or other sounds into the fixture. More particularly, it relates to an assembly for connecting such transducers while also magnetically shielding occupant's of the fixtures from magnetic fields generated by the transducers.

For experiential, therapeutic and other reasons it is desirable to project music, non-rhythmic sounds and/or other vibrations into bath tubs and other plumbing fixtures. However, it is desirable to place the vibration generation systems outside of the fixture to avoid contact between electrical devices and water, and to provide a cleaner and more elegant appearance.

One approach to achieve this is to place an electromagnetic transducer outside the fixture, against the fixture's exterior wall. See e.g. U.S. Pat. Nos. 3,585,991 and 6,523,191, DE 199,02,875 and EP 651987.

However, such transducers typically generate a magnetic field when operated in a manner that yields sufficient vibrations. The magnetic field produced by such a transducer may create interference with certain electronic devices used by a bather (such as a pacemaker or implantable defibrillator), or possibly certain electronic devices located in the bathroom near the fixture.

Resolving this concern can be problematic. For example, some proposed solutions to do so would interfere with the ability to remove and replace transducers from time to time during the life of the plumbing fixture. Other proposed solutions would interfere with the ability of the transducer to effectively transmit vibrations to and then through the tub wall.

As a result, a need exists for an improved transducer assembly that provides the desired vibrations to the plumbing fixture, but does not expose fixture occupants to undesirable magnetic fields.

SUMMARY OF THE INVENTION

In one aspect the present invention provides a plumbing fixture having mounted on an exterior wall thereof an electromagnetic transducer assembly. This assembly has a shield (a magnetic shield) mountable to the exterior wall (optionally removably mountable) and defining an internal cavity, a transducer having at least a portion thereof mounted in the cavity, and a means for transmitting vibrations from the transducer, past the shield, to the exterior wall. The shield can at least to some extent shield an internal portion of the plumbing fixture from magnetic fields generated by the transducer.

In one form there is a bracket positioned on an exterior wall of the plumbing fixture and sandwiched between that wall and the shield, such that the shield is removably mounted on the bracket. The shield and bracket can be removably linked to each other by a bayonet type connection and the bracket can optionally also be made from a magnetically shielding material.

A variety of means can be contemplated to transmit vibrations from the transducer, past the shield, to the bracket, and thus to the fixture. However, this needs to be done in a way that doesn't materially degrade the effectiveness of the magnetic shielding. Hence, it is proposed to create a small hole through a forward wall of the shield and pass a small diameter post through the wall. The post extends between the transducer and bracket and carries vibrations between them, past the shield.

In other forms a rearward portion of the post is threaded to an armature of the transducer, the shield is formed of steel, and the shield is essentially cup-shaped, with an open outward end. There can also be a shield cover configured to essentially enclose the transducer within the cavity.

A most preferred form of the invention is where the plumbing fixture is a bathtub or a shower enclosure, where the transducer is electronically controlled to deliver musical form vibrations.

It should be appreciated that the present invention provides a way of mounting a transducer to a plumbing fixture where the transducer can readily be removed for replacement or repair. For example, as will be understood from the following description, the transducer can simply be screwed on or off the post to mount it in place.

Further, an effective magnetic shielding is achieved without compromising maintenance access to the transducer, or the ability of the transducer to effectively carry music or other vibrations to the tub interior.

These and still other aspects of the present invention will be apparent from the detailed description and drawings. However, what follows are merely preferred example embodiments of the present invention. The claims should be referenced to assess the full scope of the invention.

BRIEF DESCRIPTION OF THE DRAWINGS

FIG. 6 is a view somewhat similar to that of FIG. 3, but of a second embodiment;

FIG. 7 is a partially exploded view thereof;

DETAILED DESCRIPTION OF THE PREFERRED EMBODIMENTS

Figure 1:
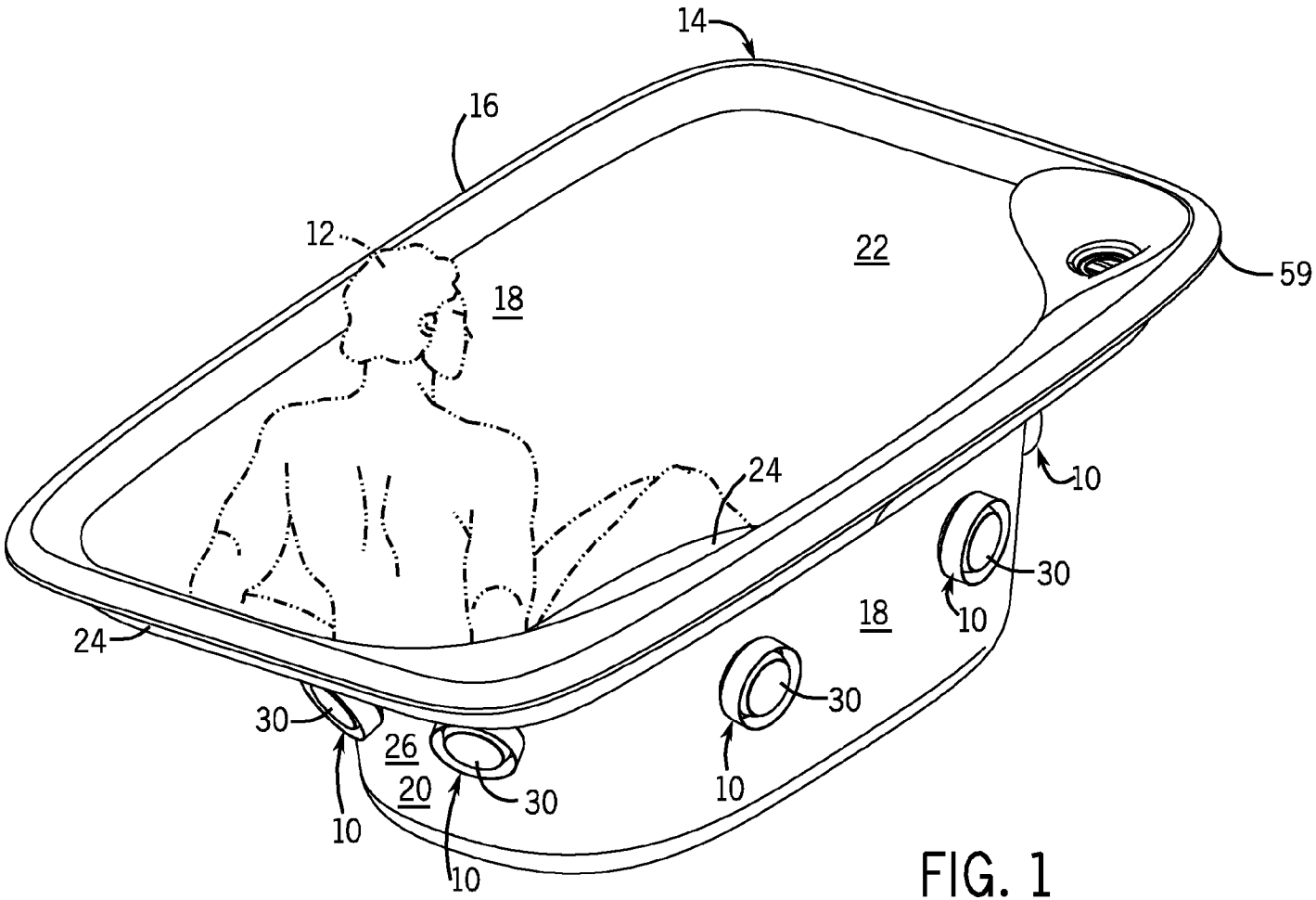
FIG. 1 is a perspective view of a bathtub embodying the present invention.
Figure 2:
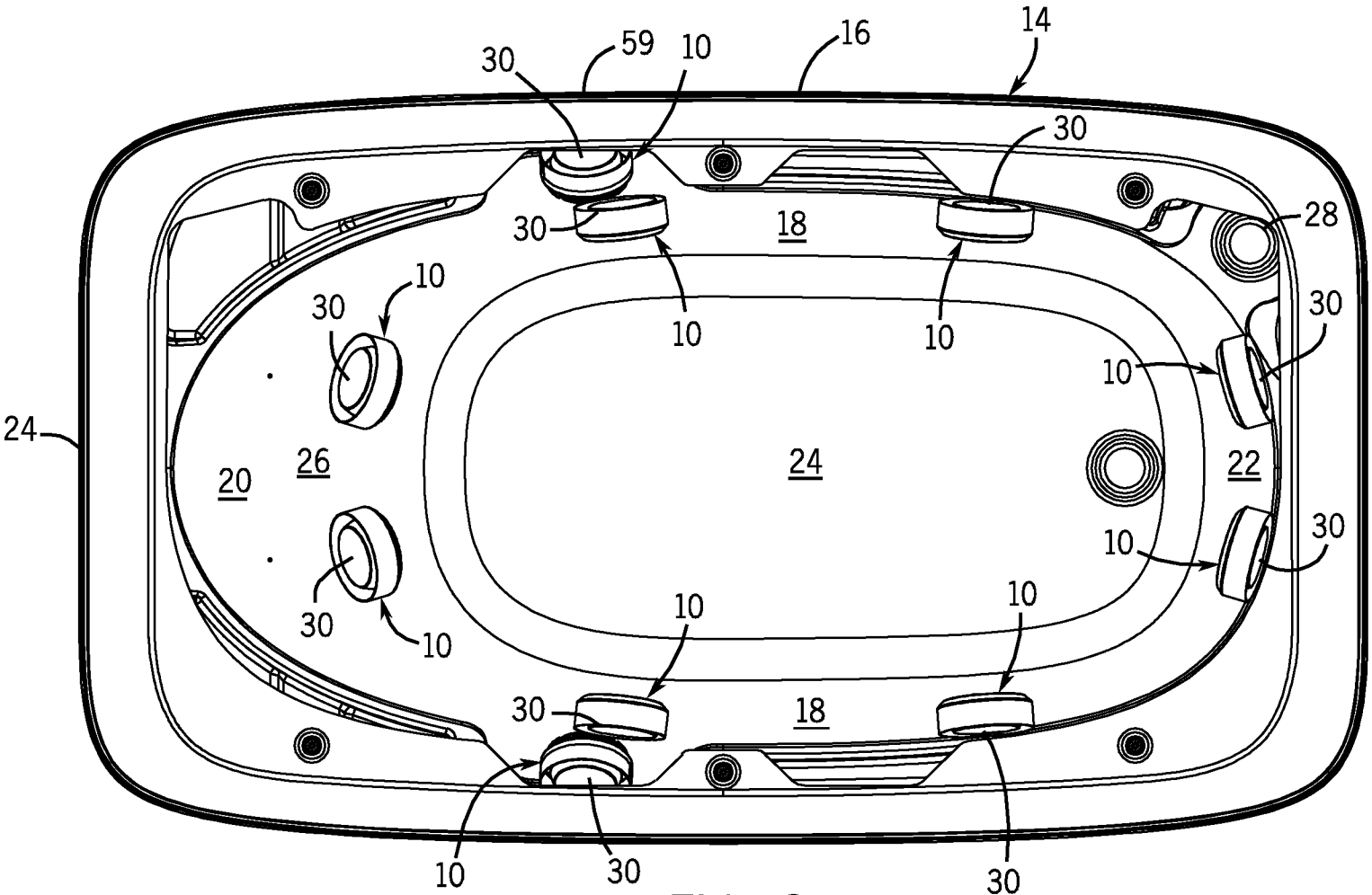
FIG. 2 is a bottom plan view thereof.
Figure 3:
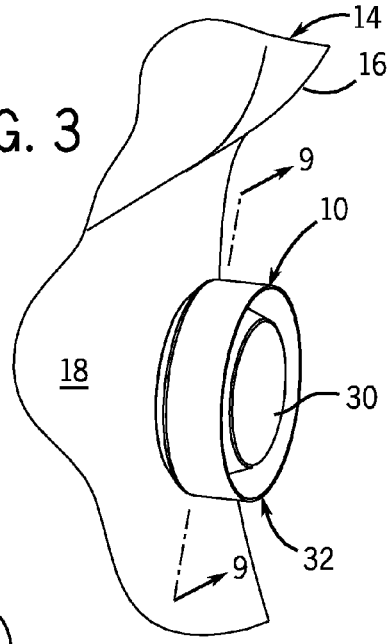
FIG. 3 is a detailed perspective view of a portion thereof on which a first transducer assembly of the present invention is mounted.
Figure 4:
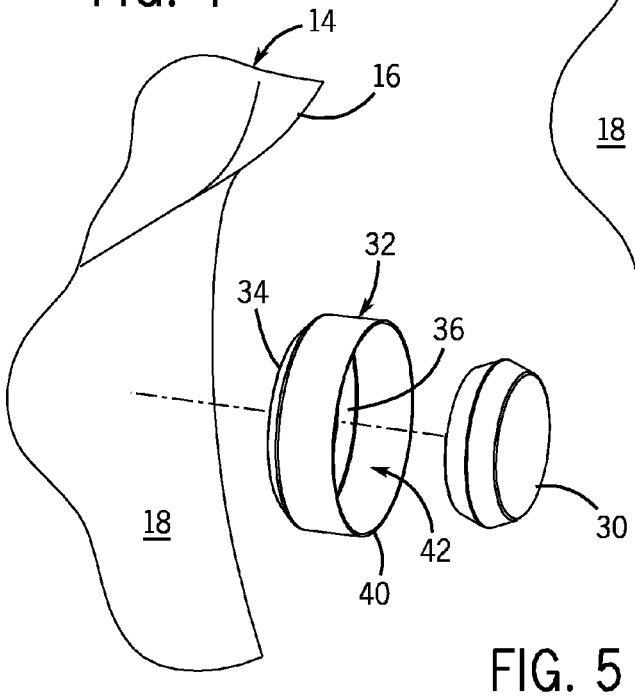
FIG. 4 is a partially exploded view of the device of FIG. 3.

In FIG. 1 there are shown multiple transducer shield assemblies 10 capable of shielding a bather 12 from magnetic fields generated by transducers 30 which transmit musical vibrations to the tub 14. The tub 14 has a shell 16 which can be a fiberglass reinforced plastic or other conventional tub material.

The shell 16 includes a pair of side walls 18, a head wall 20, a foot wall 22, and a bottom wall 24 which collectively define an internal portion of the tub in which water is conventionally placed. The head wall 20 may include a backrest portion 26.

The transducers 30 are preferably electromagnetic. One particularly preferred transducer is the disk form Rolen-Star audio transducer. It receives an input signal via terminals 30*a*, 30*b* to produce a corresponding vibration that is transmitted to the tub.

While not shown, these terminals are connected to an electronic controller, which governs the electrical power according to the pattern of the desired vibrations and experience. For example, the controller could provide a power pattern consistent with musical vibrations, such that a consumer using the tub would be able to listen to music and receive a soft massage while bathing.

A first preferred transducer assembly is shown most clearly in FIGS. 3, 4, 5, and 9. It has a cup-shaped shield 32 sized to at least partially house a transducer 30. The shield 32 has an inwardly directed base 34 that defines an interior surface 36 and an exterior surface 38. A shield rim 40 extends outward from the base 34, away from the exterior surface 38 to define a cavity 42 that is preferably sized to house essentially the entire transducer 30.

In this first embodiment the shield 32 can be secured directly to the shell 16 of the tub 14 via adhesive, caulk, epoxy, or any other method capable of withstanding the repetitive vibrations produced by the transducer 30. The shield 32 is mounted such that the post 44 (in this case in the form of a bolt) is in direct contact with, for example, the side wall 18 of the tub 14 (shown in FIG. 9). This allows for an efficient transfer of vibrations from outside of the shell 16 (from the transducer).

Figure 5:
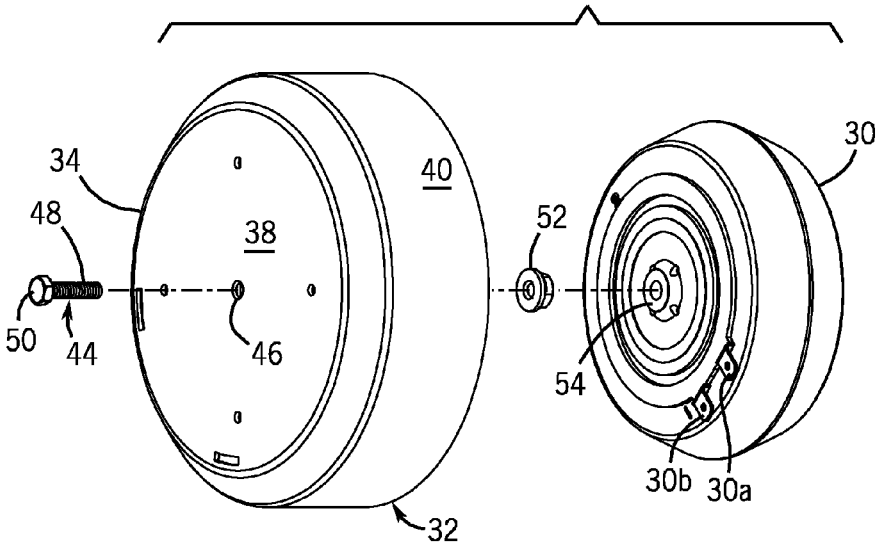
FIG. 5 is an exploded perspective view, taken more from the inward side, of the first transducer assembly of the present invention.
Figure 8:
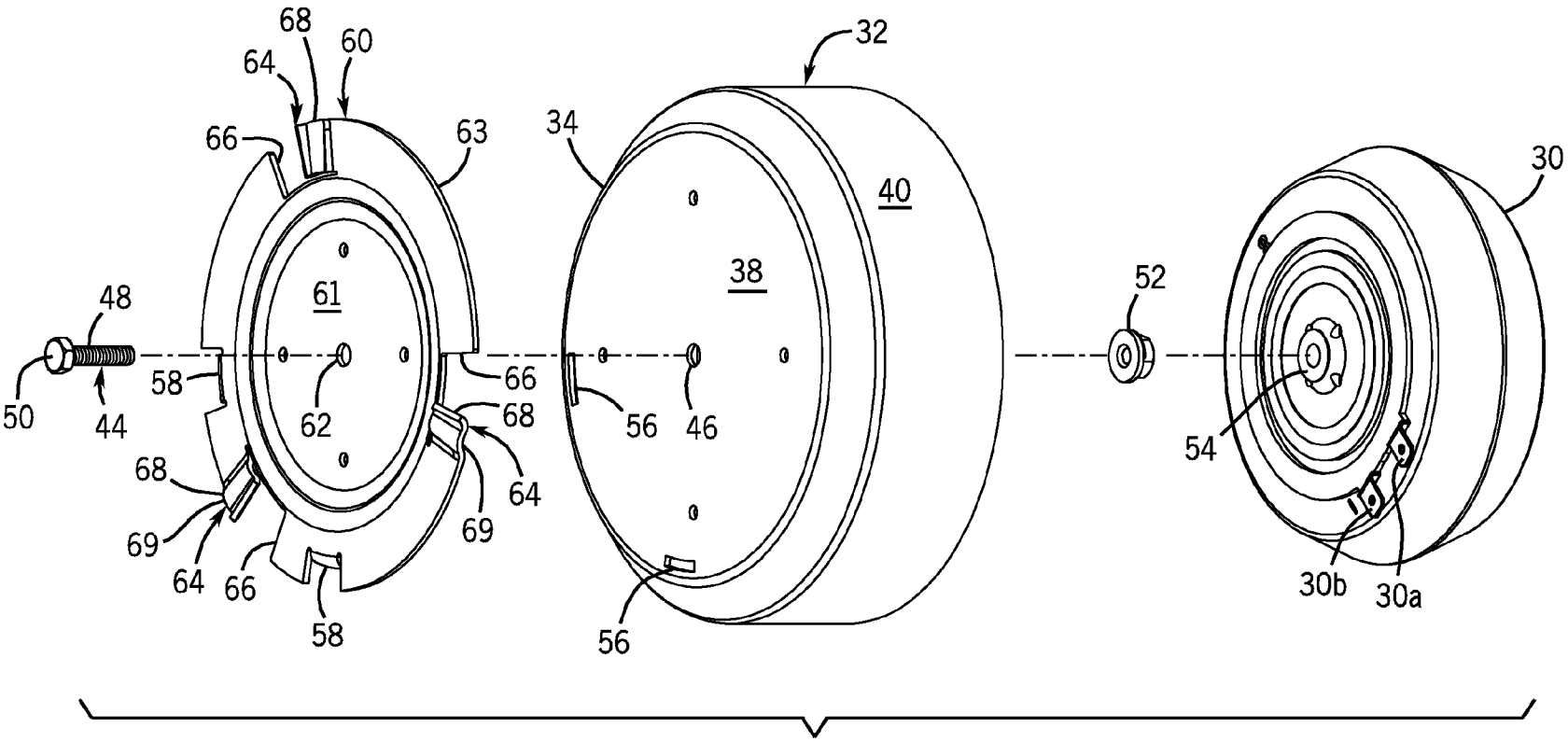
FIG. 8 is a view similar to that of FIG. 5, but of the second embodiment.
Figure 9:
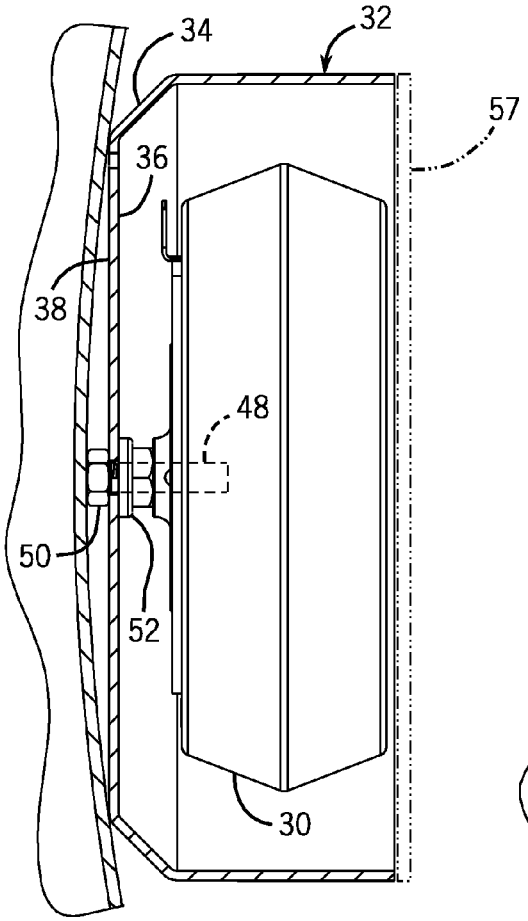
FIG. 9 is a cross sectional view taken along line 9-9 of FIG. 3.

With specific reference to FIGS. 5 and 9, the base 34 includes an opening 46 through which a threaded shaft 48 of the bolt form post 44 extends until the head 50 of the post 44 abuts the exterior surface 38 of the base 34. A fastener 52, such as a threaded toothed hex nut, engages the shaft 48 of the bolt form post 44 to sandwich the base 34 of the shield 32 between the head 50 and the fastener 52.

The post 44 threadably engages a mating threaded armature 54 of the transducer 30. The armature 54 is actuated by the vibrations of the transducer and vibrates the coupled post 44.

The shield 32 is preferably made of a magnetically shielding material. However, given that this is a water related environment which likely has great humidity, it is desirable to use a material which is also rust-resistant. Hence, rather than using just a cast iron shield, we prefer using galvanized steel having magnetic field attenuation properties of preferably greater than twenty-five to one.

Thus, provided a one-hundred and twenty-five Gauss input provided by the transducer 30 housed adjacent the interior surface 36, the shield 32 material, thickness, and configuration is designed to attenuate the magnetic field adjacent the exterior surface 38 to no more than five Gauss, measured at a distance about one inch from the exterior surface 38.

While the shield 32 of the first example embodiment does not fully encompass the transducer 30, the shield 32 may be configured to more fully enclose the transducer 30. For example, with reference to FIG. 9, a back plate cover 57 (shown in dashed lines in FIG. 9) or a similar structure may be coupled to the rear of the shield 32 to enclose the transducer 30 within the cavity 42.

If a cover is used, it is preferably attached via threads or another temporary means (rather than welding) so that the transducer can be accessed from time to time for maintenance. A wire port (not shown) is preferably included in the cover to allow the input wires to reach the terminals 30*a*, 30*b* if a cover is used.

Turning next to FIGS. 6, 7, 8, and 10, the second mounting configuration may be used to mount a transducer 30. This is especially useful when limited access to a mounting location is available, such as the situation where the transducers 30 are mounted under a ledge 59 of the tub 14 (shown in FIG. 1).

Here, all the parts are essentially the same except for the addition of a shield plate and a bracket between the shield and tub, and associated linkages there between. The base 34 includes an anti-rotation structure in the form of a pair of slots 56 that engage a mating anti-rotation structure in the form of a pair of protrusions 58 formed in a shield plate 60. The protrusions 58 of the shield plate 60 are configured to engage slots 56 of the shield 32 to prevent relative rotation between the shield plate 60 and the shield 32 during installation or removal of the shield 32 from the tub 14.

The shield plate 60 also includes an opening 62 through which the threaded shaft 48 of the post 44 extends. The shaft 48 continues through the opening 46 in the base 34 where a fastener 52 engages the shaft 48 to effectively clamp the shield plate 60 and the shield 32 between the head 50 of the post 44 and the fastener 52. As discussed above, the anti-rotation structures are aligned so that the protrusions 58 of the shield plate 60 extend into and are captured by the slots 56 formed in the shield 32.

The disk shaped shield plate 60 is sized to essentially extend to the boundaries of the shield 32 and includes a central offset portion 61 that preferably abuts the exterior surface 38 of the shield 32. The offset portion 61 helps accommodate an interlock in the form of a plurality of notched tabs 64 formed along the periphery 63 of the shield plate 60. The tabs 64 include a notch 66 adjacent a resilient undulation 69. The tabs 64 engage a mating interlock formed in a bracket 70 affixed to the tub 14.

It should be appreciated that the shield 32 and shield plate 60 could instead be integrally formed as one piece. However, in this embodiment they are made in two pieces for ease of manufacture.

Turning next to FIG. 7, a bracket 70 is shown affixed to the side wall 18. It is permanently secured to the enclosure with adhesive, caulk, epoxy, fiberglassing in, or by any other suitable method. Preferably, the bracket 70 is the same as the shield plate 60 such that the manufacturing process is simplified. The bracket 70 thus includes the tabs 64, the notches 66, and the offset portion 61. The anti-rotation structure (e.g., protrusions 58) of the bracket 70 simply abuts the shell 16 to provide some clearance from the shell 16 of the tub 14.

The shield 32 and coupled shield plate 60 are releasably interlocked to the bracket 70 by aligning the resilient tabs 68 of the shield plate 60 with the mating notches 66 in the bracket 70. Relative rotation between the shield plate 60 and the bracket 70 forces the mating resilient tabs 68 of the respective shield plate 60 and bracket 70 to deflect and ride along the mating tab 68.

The tabs 68 ride along each other into an undulation 69 that seats the tabs 68. Rotation of the shield plate 60 in the opposite direction results in the tabs 68 disengaging and thus allowing the shield 32 to be removed from engagement with the tub 14. Installation and removal of the shield 32 requires minimal lateral clearance around the shield 32 and transducer 30. As a result, the shield 32 and coupled transducer 30 can be easily installed and removed from the tub 14 for service and repair.

Hence, they form a bayonet type of removable connection. The brackets can be attached at the factory, and the remainder of the assembly linked on-site to them.

Figure 10:
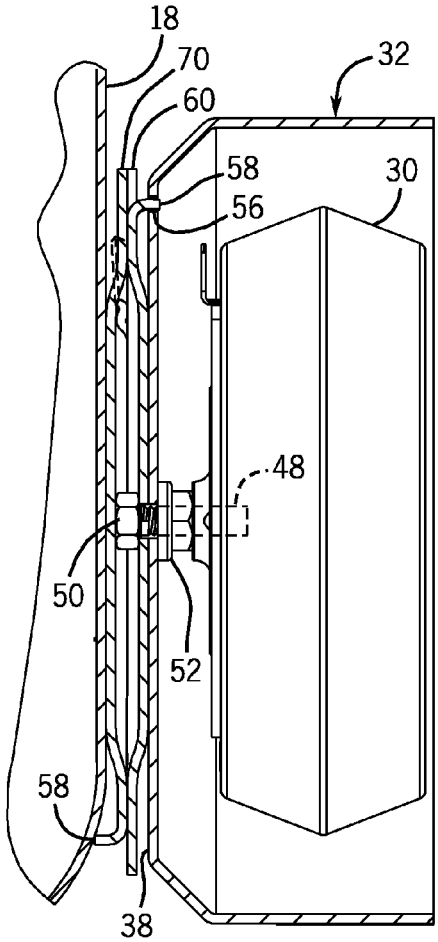
FIG. 10 is a cross sectional view taken along line 10-10 of FIG. 6.

With brief further reference to FIG. 10, the head 50 of the post 44 preferably is in contact with the adjacent bracket 70 to efficiently transmit the vibration of the transducer 30 to the shell 16.

To provide additional attenuation of any magnetic field generated by the transducer 30, both the shield plate 60 and the bracket 70 may be produced from a magnetically shielding material such as galvanized steel A568, or any other suitable material.

Preferred example embodiments of the present invention have been described in considerable detail. Many modifications and variations of the preferred example embodiment described will be apparent to a person of ordinary skill in the art. For example, the shield could be a square cup, with the transducer housing being rectangular rather than disk shaped.

Therefore, the invention should not be limited to the example embodiments described. Rather, the claims should be looked to in order to judge the full scope of the invention.

INDUSTRIAL APPLICABILITY

The invention provides an assembly for mounting a vibroacoustic transducer to a bathtub or the like, where the assembly transmits musical or other vibrations efficiently to the tub, while effectively shielding users of thereof from exposure to strong magnetic fields.

What is claimed is:

1. A plumbing fixture having mounted on an exterior wall thereof an electromagnetic transducer assembly, the assembly comprising:

a shield mounted to the exterior wall and defining an internal cavity;

a transducer having at least a portion thereof mounted in the cavity; and a means for transmitting vibrations from the transducer, past the shield, to the exterior wall;

whereby the shield can at least to some extent shield an internal portion of the plumbing fixture from magnetic fields generated by the transducer, wherein the shield is removably mounted to the exterior wall and the assembly further comprises a bracket positioned on an exterior wall of the plumbing fixture and sandwiched between that wall and the shield, such that the shield is removably mounted on the bracket.

2. The plumbing fixture of claim 1, wherein the shield is essentially cup-shaped, with an open outward end.

3. The plumbing fixture of claim 1, wherein the transducer is in the form of a unit that has some internal magnetic shielding.

4. The plumbing fixture of claim 1, wherein the shield and bracket are removably linked to each other by a bayonet type connection.

5. The plumbing fixture of claim 1, wherein the bracket comprises a magnetic shielding material.

6. The plumbing fixture of claim 1, wherein the means for transmitting vibrations comprises a post extending between the transducer and the bracket.

7. The plumbing fixture of claim 6, wherein the shield further comprises a central opening and the post extends through the opening.

8. The plumbing fixture of claim 6, wherein a rearward portion of the post is threaded to an armature of the transducer.

9. The plumbing fixture of claim 1, wherein the shield is formed of steel and is configured to act to at least some extent to shield an internal portion of the plumbing fixture from magnetic fields generated by the transducer.

10. The plumbing fixture of claim 1, wherein the plumbing fixture is a bathtub.

11. The plumbing fixture of claim 1, wherein the plumbing fixture is a shower enclosure.

12. The plumbing fixture of claim 1, wherein the bracket is affixed to the external wall by an adhesive or by fiberglassing integral with the external wall.

13. A plumbing fixture having mounted on an exterior wall thereof an electromagnetic transducer assembly, the assembly comprising:

a shield mounted to the exterior wall and defining an internal cavity;

a transducer having at least a portion thereof mounted in the cavity; and a means for transmitting vibrations from the transducer, past the shield, to the exterior wall;

whereby the shield can at least to some extent shield an internal portion of the plumbing fixture from magnetic fields generated by the transducer, wherein the shield is formed of steel and is configured to act to at least some extent to shield an internal portion of the plumbing fixture from magnetic fields generated by the transducer, and wherein the shield is essentially cup-shaped, with an open outward end.

14. The plumbing fixture of claim 13, wherein the plumbing fixture is selected from the group consisting of a bathtub and a shower enclosure.

15. A plumbing fixture having mounted on an exterior wall thereof an electromagnetic transducer assembly, the assembly comprising:

a shield mounted to the exterior wall and defining an internal cavity;

a transducer having at least a portion thereof mounted in the cavity; and a means for transmitting vibrations from the transducer, past the shield, to the exterior wall;

whereby the shield can at least to some extent shield an internal portion of the plumbing fixture from magnetic fields generated by the transducer, wherein the transducer is in the form of a unit that has some internal magnetic shielding.

16. The plumbing fixture of claim 15, wherein the shield is configured to at least partially shield an internal portion of the plumbing fixture from magnetic fields generated by the transducer.

17. The plumbing fixture of claim 16, wherein the shield is essentially cup-shaped, with an open outward end.

18. The plumbing fixture of claim 16, wherein the shield is essentially cup-shaped with a closed outward end;

wherein the closed outward end comprises a shield cover configured to be removable and to enclose the transducer within the cavity when installed on the shield.

19. The plumbing fixture of claim 15, wherein the plumbing fixture is a bathtub.

20. The plumbing fixture of claim 15, wherein the plumbing fixture is a shower.

21. The plumbing fixture of claim 15, where in the shield is removably mounted to the exterior wall.

22. The plumbing fixture of claim 21, wherein the means for transmitting comprise:

a bracket positioned on the exterior wall of the plumbing fixture and sandwiched between the exterior wall and the shield such that the shield is removably mounted on the bracket, thereby providing the removability of the shield relative to the exterior wall.

23. The plumbing fixture of claim 15, further comprising:

a bracket positioned on the exterior wall of the plumbing fixture and sandwiched between the exterior wall and the shield.

24. The plumbing fixture of claim 23, wherein the shield is removably mounted on the bracket.

25. The plumbing fixture of claim 24, wherein the shield and bracket are removably linked to each other by a bayonet type connection.

26. The plumbing fixture of claim 23, wherein the means for transmitting vibrations comprises a post extending between the transducer and the bracket.

27. The plumbing fixture of claim 26, wherein the shield further comprises a central opening and the post extends through the opening, wherein a rearward portion of the post is threaded to an armature of the transducer.

28. The plumbing fixture of claim 15, further comprising:

an electronic controller having wires which provide alternating current to the transducer, wherein the electronic controller is configured to vary the alternating current to provide a pattern of vibrations through the transducer and the means for transmitting to the external wall such that the external wall of the plumbing fixture is used as a speaker diaphragm for playback of music.

29. The plumbing fixture of claim 28, wherein the external wall is the wall of a bathtub and the side of the external wall opposite the transducer forms the shell of the bathtub that is filled with water, and wherein the shell is not broken to accommodate the transducer or bracket.

30. The plumbing fixture of claim 29, wherein the means for transmitting vibrations from the transducer comprises:

a plate for securing to between the external wall and the shield.

31. The plumbing fixture of claim 29, wherein the means for transmitting vibrations from the transducer comprises:

a bracket adhered to the external wall; and a plate configured to secure the shield to the bracket.

32. The plumbing fixture of claim 15, wherein the shield is secured directly to the exterior wall via an adhesive.

* * * * *